US010909968B2

(12) United States Patent
Barathan et al.

(10) Patent No.: US 10,909,968 B2
(45) Date of Patent: Feb. 2, 2021

(54) ENHANCED CACHE CONTROL FOR TEXT-TO-SPEECH DATA

(71) Applicant: ARRIS Enterprises LLC, Suwanee, GA (US)

(72) Inventors: Jeyakumar Barathan, Bangalore (IN); Krishna Prasad Panje, Bangalore (IN)

(73) Assignee: ARRIS Enterprises LLC, Suwanee, GA (US)

( * ) Notice: Subject to any disclaimer, the term of this patent is extended or adjusted under 35 U.S.C. 154(b) by 126 days.

(21) Appl. No.: 16/213,645

(22) Filed: Dec. 7, 2018

(65) Prior Publication Data

US 2020/0184949 A1 Jun. 11, 2020

(51) Int. Cl.
*G10L 13/047* (2013.01)
*G10L 13/08* (2013.01)

(52) U.S. Cl.
CPC ..... *G10L 13/047* (2013.01); *G10L 13/08* (2013.01)

(58) Field of Classification Search
CPC ..... G10L 13/047; G10L 13/08
See application file for complete search history.

(56) References Cited

U.S. PATENT DOCUMENTS 7,483,834 B2 1/2009 Naimpally et al.
2004/0267645 A1* 12/2004 Pollari ..... G06Q 20/14 705/34
2015/0248887 A1* 9/2015 Wlodkowski ..... H04N 21/472 704/246
2015/0319261 A1* 11/2015 Lonas ..... G06F 12/0875 709/216

* cited by examiner

*Primary Examiner* — Sonia L Gay
(74) *Attorney, Agent, or Firm* — Wenderoth, Lind & Ponack, L.L.P.

(57) ABSTRACT

Methods, systems, and computer readable media can be operable to facilitate controlled caching of text-to-speech data. When text is identified for a text-to-speech conversion, a duration value to be associated with the text may be determined, and the identified text and duration value may be included within a request for a conversion of the text. An intermediate server may retrieve a speech file that is generated in response to the conversion request, and the intermediate server may cache the speech file for a certain period of time that is indicated by the duration value.

12 Claims, 6 Drawing Sheets

ENHANCED CACHE CONTROL FOR TEXT-TO-SPEECH DATA

TECHNICAL FIELD

This disclosure relates to enhanced cache control for text-to-speech data.

BACKGROUND

Media devices such as set-top boxes (STB) may be configured with a text-to-speech (TTS) accessibility feature. With the text-to-speech feature enabled, displayed text (e.g., guide text, info text, etc.) may be converted to speech for visually impaired viewers. However, STB resource constraints preclude the placement of a TTS synthesizer within STBs. Cloud based TTS synthesis solutions may be used, but the cloud based solutions are costly due to the large number of conversions. Moreover, latency between the display of text and the output of speech associated with the text can be problematic in a cloud based solution. Further, resource constraints at STBs do not allow speech files to be cached in a manner that sufficiently addresses the latency issues. Therefore, it is desirable to improve upon methods and systems for caching text-to-speech data.

BRIEF DESCRIPTION OF THE DRAWINGS

Like reference numbers and designations in the various drawings indicate like elements.

DETAILED DESCRIPTION

It is desirable to improve upon methods and systems for caching text-to-speech data. Methods, systems, and computer readable media can be operable to facilitate controlled caching of text-to-speech data. When text is identified for a text-to-speech conversion, a duration value to be associated with the text may be determined, and the identified text and duration value may be included within a request for a conversion of the text. An intermediate server may retrieve a speech file that is generated in response to the conversion request, and the intermediate server may cache the speech file for a certain period of time that is indicated by the duration value.

Figure 1:
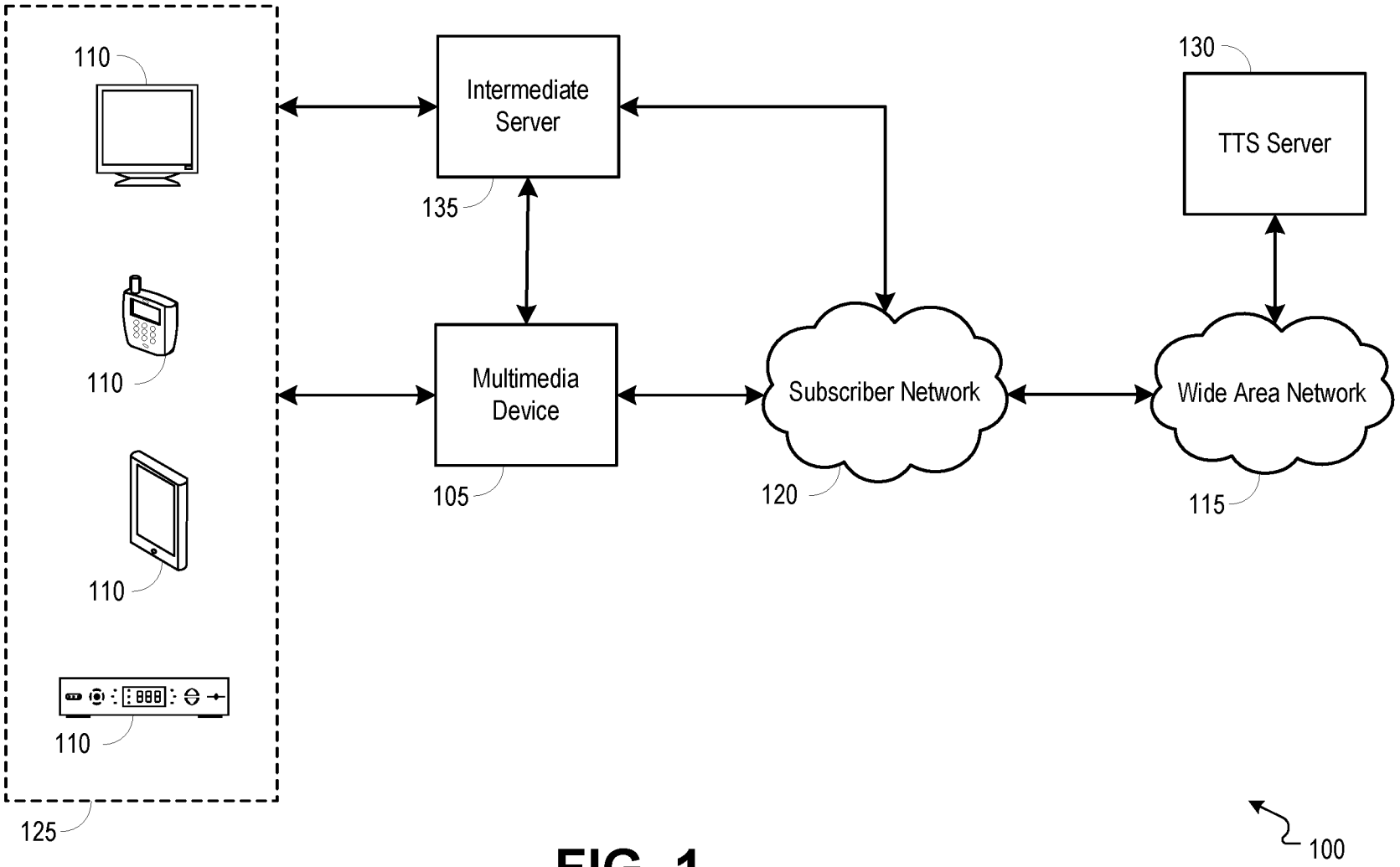
FIG. 1 is a block diagram illustrating an example network environment operable to facilitate controlled caching of text-to-speech data.

FIG. 1 is a block diagram illustrating an example network environment 100 operable to facilitate controlled caching of text-to-speech data. In embodiments, one or more multimedia devices 105 (e.g., set-top box (STB), multimedia gateway device, etc.) may provide video, data and/or voice services to one or more client devices 110 by communicating with a wide area network (WAN) 115 through a connection to a subscriber network 120 (e.g., a local area network (LAN), a wireless local area network (WLAN), a personal area network (PAN), mobile network, high-speed wireless network, etc.). For example, a subscriber can receive and request video, data and/or voice services through a variety of types of client devices 110, including but not limited to a television, computer, tablet, mobile device, STB, and others. It should be understood that a multimedia device 105 may communicate directly with, and receive one or more services directly from a subscriber network 120 or WAN 115. A client device 110 may receive the requested services through a connection to a multimedia device 105, through a direct connection to a subscriber network 120 (e.g., mobile network), through a direct connection to a WAN 115, or through a connection to a local network 125 that is provided by a multimedia device 105 or other access point within an associated premise. While the components shown in FIG. 1 are shown separate from each other, it should be understood that the various components can be integrated into each other.

In embodiments, a multimedia device 105 may facilitate text-to-speech (TTS) conversions of text that is displayed at, expected to be displayed at, or otherwise associated with content that is provided to the multimedia device 105 or an associated client device 110. A multimedia device 105 may identify text to be converted and may generate a request for a TTS conversion of the identified text. The identified text may be identified from text to be presented through the multimedia device 105, or the identified text may be identified from a TTS conversion request received at the multimedia device 105 from a client device 110.

In embodiments, the multimedia device 105 may generate and output a request for a TTS conversion. For example, the TTS conversion request may be output to a TTS server 130. The TTS server 130 may be a cloud-based server, and the TTS conversion request may be output to the TTS server 130 through the subscriber network 120 and/or wide area network 115. It should be understood that the TTS conversion request may be received at the multimedia device 105 from a client device 110, and the multimedia device 105 may forward the TTS conversion request to the TTS server 130.

In embodiments, a TTS conversion request may be sent to and received by an intermediate server 135. The TTS conversion request may include an identification of text that is to be converted, and the TTS conversion request may include a duration value, wherein the duration value provides an indication as to how long a speech file associated with the text is to be cached at the intermediate server 135. In response to receiving the TTS conversion request, the intermediate server 135 may carry out or initiate a TTS conversion of the text identified within the request.

In embodiments, the multimedia device 105 or a client device 110 may identify text that is to be converted. For example, the identified text may be text (e.g., text identified from a guide or any other text that may be displayed on a screen) that is currently or that may be expected to be displayed through the multimedia device 105 or client device 110. The multimedia device 105 or client device 110 may determine a duration value to associate with text identified for conversion. The duration value may be a default value, or the duration value may be determined based upon one or more properties associated with the identified text. For example, the one or more properties may include an identification of an application associated with the text (e.g., text associated with a guide application may be given a duration value that is associated with a period of time associated with the guide, text associated with a user interface or playback application may be given a longer or permanent duration value, text associated with a streaming video application may be given a duration value that is associated with a length of time for which the content will be maintained, etc.), an identification of a content type with which the text is associated (e.g., an identification of a list associated with the content such as "recommended," "trending," "music," "live," etc.), an identification of a number of times the content with which the text is associated has been watched, and/or other information associated with the text or the content or application with which the text is associated.

In embodiments, in response to receiving a TTS conversion request carrying text that is to be converted, the intermediate server 135 may output a request for a TTS conversion of the text to a TTS server 130. The TTS server 130 may carry out a TTS conversion of the text, thereby producing a speech file associated with the text. The TTS server 130 may output the speech file associated with the text to the intermediate server 135, and upon receiving the speech file from the TTS server 130, the intermediate server 135 may cache the speech file. The intermediate server 135 may cache the speech file according to a duration value identified from the received TTS conversion request. For example, the intermediate server 135 may cache the speech file at the intermediate server 135 for a period of time that is indicated by the duration value.

In embodiments, the intermediate server 135 may output a speech file to a multimedia device 105 or client device 110, and the intermediate server 135 may continue to cache the speech file according to a duration value that is associated with the speech file. Along with the speech file, the intermediate server 135 may output instructions for caching the speech file at the multimedia device 105 or client device 110. For example, the intermediate server 135 may instruct the multimedia device 105 or client device 110 to cache the speech file locally for a certain period of time that is indicated by the duration value associated with the speech file.

Figure 2:
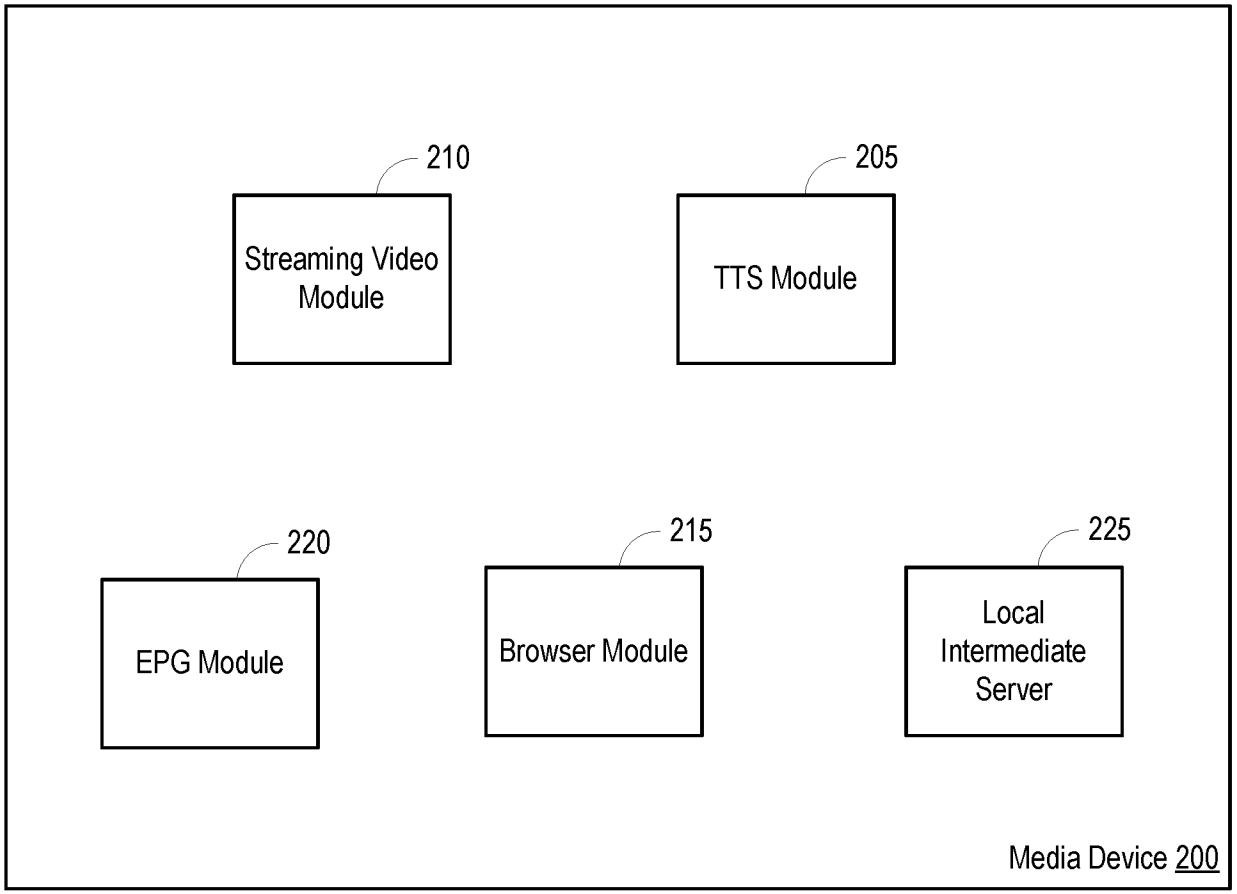
FIG. 2 is a block diagram illustrating an example media device operable to facilitate controlled caching of text-to-speech data.

FIG. 2 is a block diagram illustrating an example media device 200 operable to facilitate controlled caching of text-to-speech data. The media device 200 may be a multimedia device 105 of FIG. 1 or a client device 110 of FIG. 1. The media device 200 may include a TTS module 205, a streaming video module 210, a browser module 215, and an EPG (electronic program guide) module 220. In embodiments, the media device 200 may include a local intermediate server 225.

In embodiments, a TTS module 205 may facilitate TTS conversions of text that is displayed at, expected to be displayed at, or otherwise associated with content that is provided to the media device 200 or to an associated multimedia device 105 or an associated client device 110. The TTS module 205 may identify text to be converted and may generate a request for a TTS conversion of the identified text. The identified text may be identified from text to be presented through the media device 200 or through a device associated with the media device 200, or the identified text may be identified from a TTS conversion request received at the media device 200 from an associated device (e.g., multimedia device 105, client device 110, etc.).

In embodiments, the TTS module 205 may generate and output a request for a TTS conversion. For example, the TTS conversion request may be output to a TTS server 130 of FIG. 1. It should be understood that the TTS conversion request may be received at the media device 200 from an associated device, and the TTS module 205 may forward the TTS conversion request to the TTS server 130.

In embodiments, a TTS conversion request may include an identification of text that is to be converted, and the TTS conversion request may include a duration value, wherein the duration value provides an indication as to how long a speech file associated with the text is to be cached at an intermediate server 135 of FIG. 1 or a local intermediate server 225. In response to receiving the TTS conversion request, the intermediate server 135 or local intermediate server 225 may carry out or initiate a TTS conversion of the text identified within the request.

In embodiments, text that is to be converted may be identified by one or more applications operating at the media device 200. For example, the text to be converted may be identified by a streaming video module 210, a browser module 215, and/or an EPG module 220. The identified text may be text (e.g., text identified from a guide or any other text that may be displayed on a screen) that is currently or that may be expected to be displayed through the media device 200 or an associated device. The TTS module 205 may determine a duration value to associate with text identified for conversion. The duration value may be a default value, or the duration value may be determined based upon one or more properties associated with the identified text. For example, the one or more properties may include an identification of an application associated with the text (e.g., text associated with a guide application may be given a duration value that is associated with a period of time associated with the guide, text associated with a user interface or playback application may be given a longer or permanent duration value, text associated with a streaming video application may be given a duration value that is associated with a length of time for which the content will be maintained, etc.), an identification of a content type with which the text is associated (e.g., an identification of a list associated with the content such as "recommended," "trending," "music," "live," etc.), an identification of a number of times the content with which the text is associated has been watched, and/or other information associated with the text or the content or application with which the text is associated.

In embodiments, in response to receiving a TTS conversion request carrying text that is to be converted, the intermediate server 135 or local intermediate server 225 may output a request for a TTS conversion of the text to a TTS server 130 of FIG. 1. The TTS server 130 may carry out a TTS conversion of the text, thereby producing a speech file associated with the text. The TTS server 130 may output the speech file associated with the text to the intermediate server 135 or local intermediate server 225, and upon receiving the speech file from the TTS server 130, the intermediate server 135 or local intermediate server 225 may cache the speech file. The intermediate server 135 or local intermediate server 225 may cache the speech file according to a duration value identified from the received TTS conversion request. For example, the intermediate server 135 or local intermediate server 225 may cache the speech file at the intermediate server 135 or local intermediate server 225 for a period of time that is indicated by the duration value.

In embodiments, the intermediate server 135 or local intermediate server 225 may output a speech file to a multimedia device 105 or client device 110, and the intermediate server 135 or local intermediate server 225 may continue to cache the speech file according to a duration value that is associated with the speech file. Along with the speech file, the intermediate server 135 or local intermediate server 225 may output instructions for caching the speech file at a multimedia device 105 or client device 110. For example, the intermediate server 135 or local intermediate server 225 may instruct the multimedia device 105 or client device 110 to cache the speech file locally for a certain period of time that is indicated by the duration value associated with the speech file.

Figure 3:
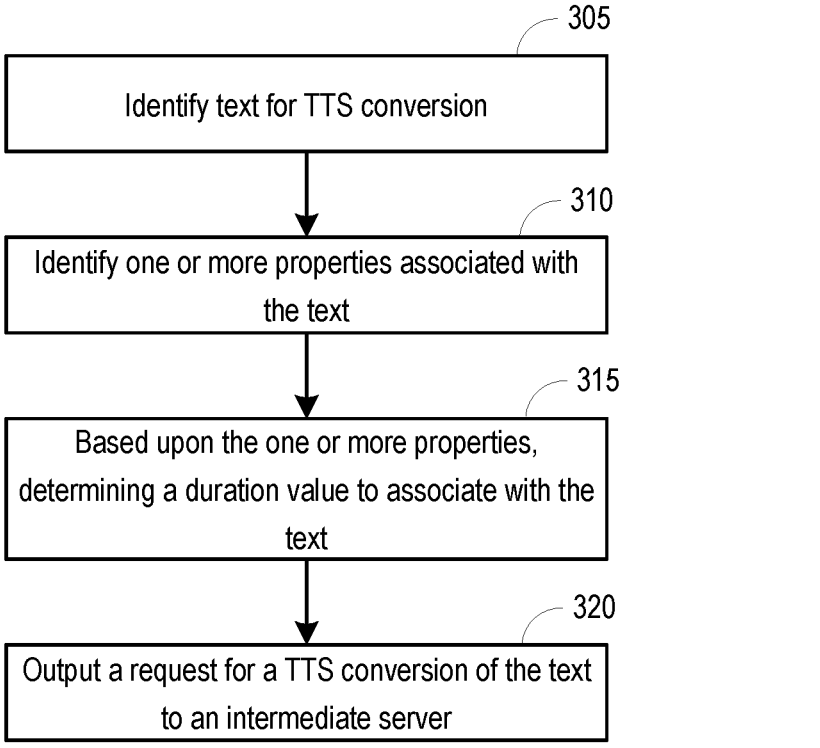
FIG. 3 is a flowchart illustrating an example process operable to facilitate a determination of a duration value that is to be associated with a TTS conversion request.

FIG. 3 is a flowchart illustrating an example process 300 operable to facilitate a determination of a duration value that is to be associated with a TTS conversion request. The process 300 may be carried out, for example, by a media device 200 of FIG. 2. The process 300 can begin at 305, when text for TTS conversion is identified. Text may be identified, for example, by the media device 200 (e.g., by a TTS module 205 of FIG. 2). In embodiments, text that is to be converted may be identified by one or more applications operating at the media device 200. For example, the text to be converted may be identified by a streaming video module 210 of FIG. 2, a browser module 215 of FIG. 2, an EPG module 220 of FIG. 2, and/or one or more other applications or modules. The identified text may be text (e.g., text identified from a guide or any other text that may be displayed on a screen) that is currently or that may be expected to be displayed through the media device 200 or an associated device (e.g., an associated multimedia device 105 of FIG. 1, an associated client device 110 of FIG. 1, etc.).

At 310, one or more properties associated with the text may be identified. The one or more properties associated with the text may be identified, for example, by the media device 200 (e.g., by the TTS module 205). In embodiments, the one or more properties associated with the text may be identified from metadata associated with the text, metadata of content associated with the text, a module or application associated with the text, or other source. The one or more properties may include an identification of an application associated with the text, an identification of a content type with which the text is associated, an identification of a number of times the content with which the text is associated has been watched, and/or other information associated with the text or the content or application with which the text is associated.

At 315, a duration value to associate with the text may be determined. The duration value to associate with the text may be determined, for example, by the media device 200 (e.g., by the TTS module 205). In embodiments, the duration value may be a default value, or the duration value may be determined based upon the one or more properties associated with the text. For example, the determination of the duration value may be based upon an identification of an application associated with the text (e.g., text associated with a guide application may be given a duration value that is associated with a period of time associated with the guide, text associated with a user interface or playback application may be given a longer or permanent duration value, text associated with a streaming video application may be given a duration value that is associated with a length of time for which the content will be maintained, etc.), an identification of a content type with which the text is associated (e.g., an identification of a list associated with the content such as "recommended," "trending," "music," "live," etc.), an identification of a number of times the content with which the text is associated has been watched, and/or other information associated with the text or the content or application with which the text is associated.

At 320, a request for a TTS conversion of the text may be output to an intermediate server. The request may be generated and output by the media device 200 (e.g., by the TTS module 205). The intermediate server may be an external server (e.g., intermediate server 135 of FIG. 1) or an internal server (e.g., local intermediate server 225 of FIG. 2). In embodiments, the TTS module 205 may generate the TTS conversion request. The request may include an identification of the text to be converted and an identification of the duration value (e.g., the duration value determined at 315).

Figure 4:
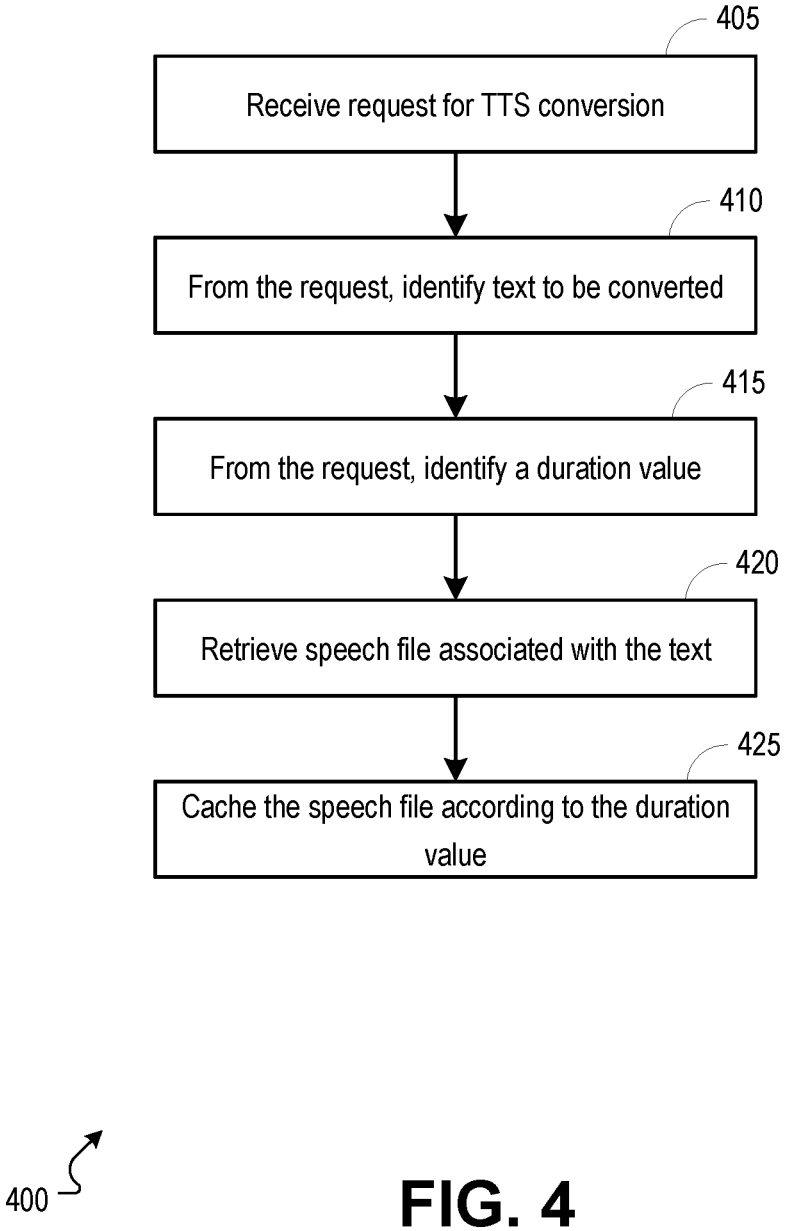
FIG. 4 is a flowchart illustrating an example process operable to facilitate a retrieval and caching of a speech file according to an associated duration value.

FIG. 4 is a flowchart illustrating an example process 400 operable to facilitate a retrieval and caching of a speech file according to an associated duration value. The process 400 may be carried out, for example, by an intermediate server (e.g., intermediate server 135 of FIG. 1, local intermediate server 225 of FIG. 2, etc.). The process 400 may begin at 405 when a request for a TTS conversion is received. The request for a TTS conversion may be received by an intermediate server. In embodiments, the request may include an identification of text to be converted and a duration value. The intermediate server may identify the text to be converted at 410, and the intermediate server may identify the duration value at 415.

At 420, a speech file associated with the text may be retrieved. The speech file associated with the text may be retrieved, for example, by the intermediate server, and the speech file may be produced from a TTS conversion of the text. In embodiments, the intermediate server may output a request for a TTS conversion of the text to a TTS server 130 of FIG. 1. The TTS server 130 may carry out a TTS conversion of the text, thereby producing a speech file associated with the text. The TTS server 130 may output the speech file associated with the text to the intermediate server, and upon receiving the speech file from the TTS server 130, the intermediate server may cache the speech file at 425. In embodiments, the intermediate server may cache the speech file according to the duration value identified from the received TTS conversion request (e.g., the duration value identified at 415). For example, the intermediate server may cache the speech file at the intermediate server for a period of time that is indicated by the duration value.

Figure 5:
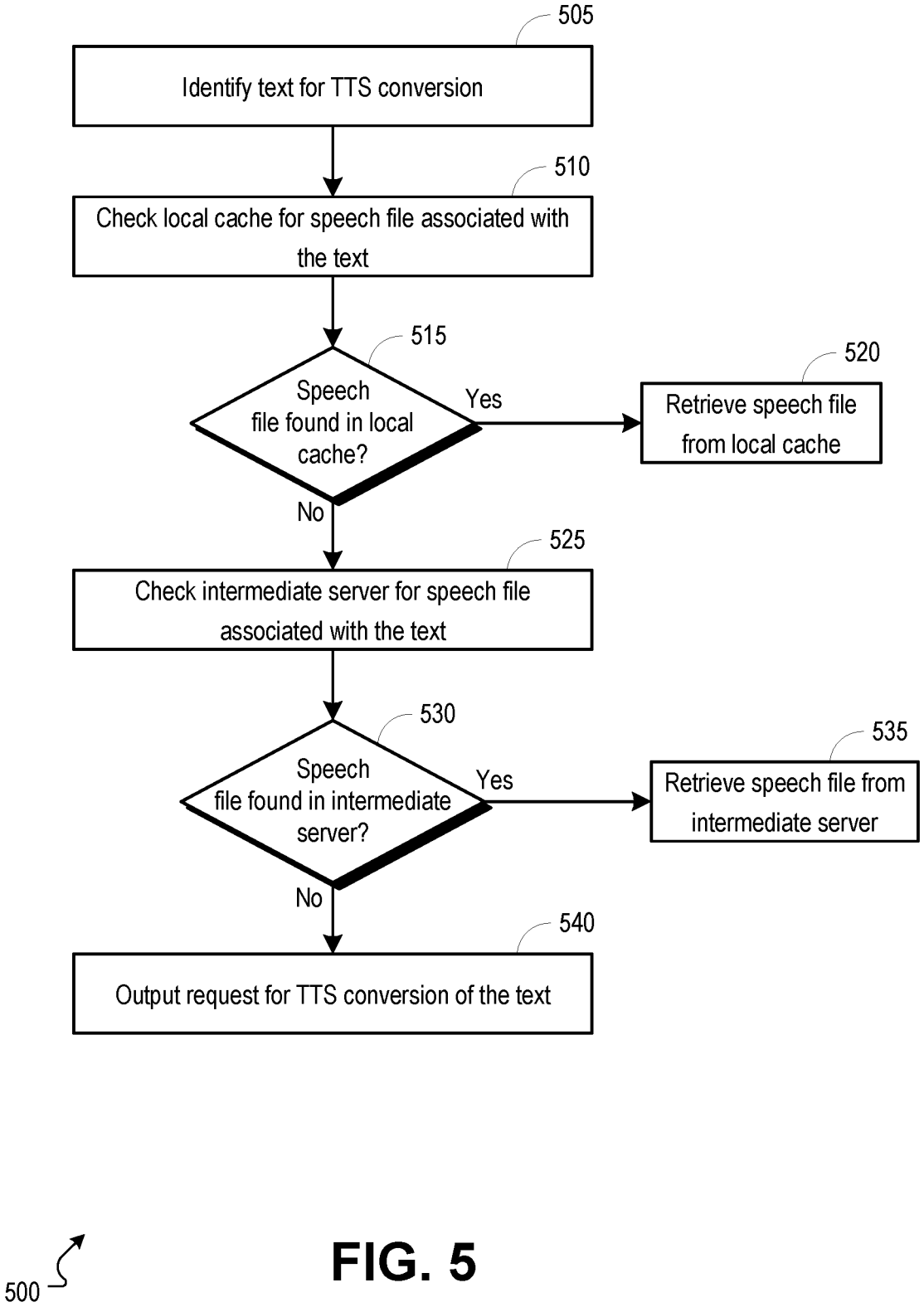
FIG. 5 is a flowchart illustrating an example process operable to facilitate a retrieval of a speech file associated with text that is identified for a TTS conversion.

FIG. 5 is a flowchart illustrating an example process 500 operable to facilitate a retrieval of a speech file associated with text that is identified for a TTS conversion. The process 500 may be carried out, for example, by a media device 200 of FIG. 2. The process 500 can begin at 505, when text is identified for a TTS conversion. Text may be identified, for example, by the media device 200 (e.g., by a TTS module 205 of FIG. 2). In embodiments, text that is to be converted may be identified by one or more applications operating at the media device 200. For example, the text to be converted may be identified by a streaming video module 210 of FIG. 2, a browser module 215 of FIG. 2, an EPG module 220 of FIG. 2, and/or one or more other applications or modules. The identified text may be text (e.g., text identified from a guide or any other text that may be displayed on a screen) that is currently or that may be expected to be displayed through the media device 200 or an associated device (e.g., an associated multimedia device 105 of FIG. 1, an associated client device 110 of FIG. 1, etc.).

At 510, a local cache may be checked for a speech file associated with the identified text. For example, the TTS module 205 may check a local cache of the media device 200 to determine whether a speech file associated with the text is cached at the media device 200. In embodiments, a speech file associated with the text may be locally cached at the media device 200 for a certain duration that is indicated by a duration value associated with the text.

At 515, a determination may be made whether a speech file associated with the text is found in the local cache. The determination whether a speech file associated with the text is found in the local cache may be made, for example, by the TTS module 205. If the determination is made that a speech file associated with the text is found in the local cache, the speech file may be retrieved from the local cache at 520. In embodiments, the speech file may be retrieved (e.g., by the TTS module 205 or other application or module of the media device 200) from the local cache and used by the media device 200 to generate an audio output of the speech file. For example, the audio of the speech file may be output from the media device 200, or the speech file may be output to an associated device (e.g., multimedia device 105 of FIG. 1, client device 110 of FIG. 1, etc.).

If, at 515, the determination is made that a speech file associated with the text is not found in the local cache, the process 500 may proceed to 525. At 525, an intermediate server may be checked for a speech file associated with the identified text. In embodiments, the TTS module 205 may check an intermediate server (e.g., intermediate server 135 of FIG. 1, local intermediate server 225 of FIG. 2, etc.) to determine whether a speech file associated with the text is cached at the intermediate server. For example, the TTS module 205 may query an intermediate server, the query identifying the text for which a speech file is sought, and the intermediate server may respond to the query by indicating whether the speech file is cached at the intermediate server. In embodiments, a speech file associated with the text may be cached at an intermediate server for a certain duration that is indicated by a duration value associated with the text.

At 530, a determination may be made whether a speech file associated with the text is found at the intermediate server. The determination whether a speech file associated with the text is found at the intermediate server may be made, for example, by the TTS module 205. If the determination is made that a speech file associated with the text is found at the intermediate server, the speech file may be retrieved from the intermediate server at 535. For example, where the speech file associated with the text is cached at the intermediate server, the intermediate server may respond to the query for the speech file by outputting the speech file to the media device 200. In embodiments, the speech file may be retrieved (e.g., by the TTS module 205) from a cache at the intermediate server and used by the media device 200 to generate an audio output of the speech file. For example, the audio of the speech file may be output from the media device 200, or the speech file may be output to an associated device (e.g., multimedia device 105, client device 110, etc.).

If, at 530, the determination is made that a speech file associated with the text is not found at the intermediate server, the process 500 may proceed to 540. At 540, a request for a TTS conversion of the text may be generated and output. For example, the TTS conversion request may be generated by the media device 200 (e.g., by the TTS module 205), and the TTS conversion request may be output to an intermediate server. The intermediate server may be an external server (e.g., intermediate server 135 of FIG. 1) or an internal server (e.g., local intermediate server 225 of FIG. 2). In embodiments, the request may include an identification of the text to be converted and an identification of a duration value associated with the text.

Figure 6:
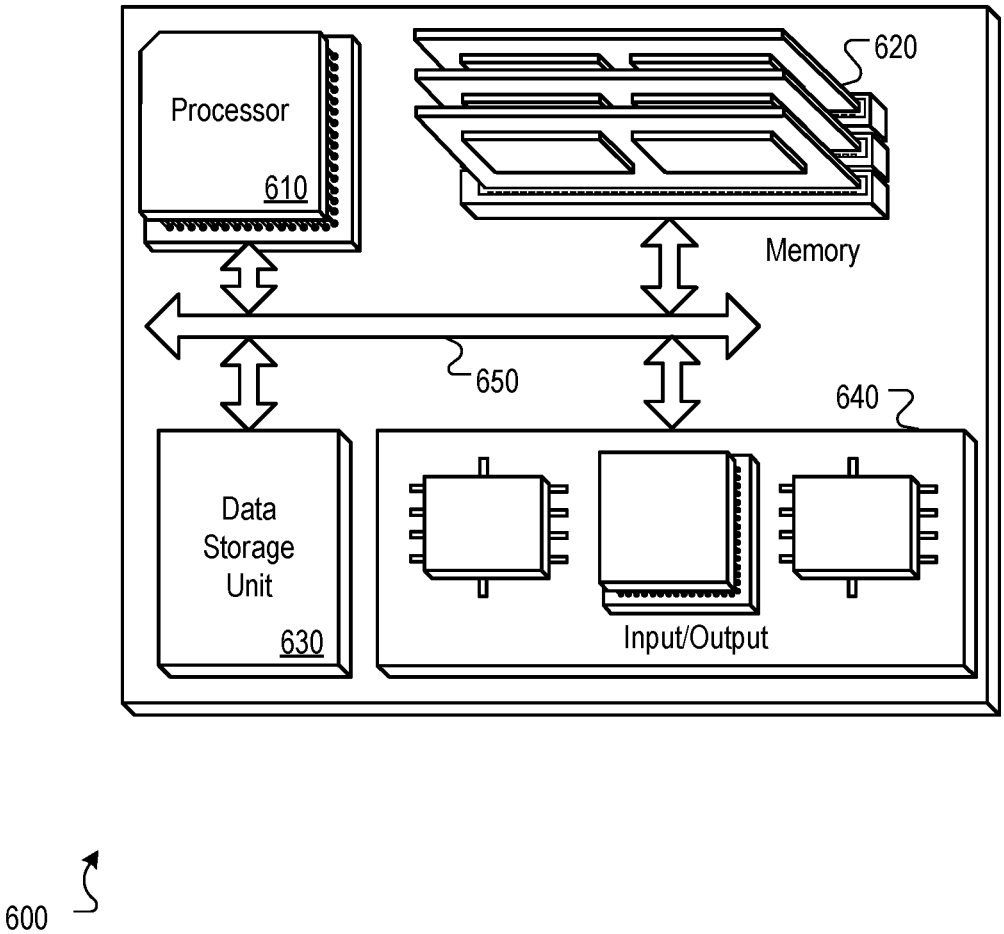
FIG. 6 is a block diagram of a hardware configuration operable to facilitate controlled caching of text-to-speech data.

FIG. 6 is a block diagram of a hardware configuration 600 operable to facilitate controlled caching of text-to-speech data. The hardware configuration 600 can include a processor 610, a memory 620, a storage device 630, and an input/output device 640. Each of the components 610, 620, 630, and 640 can, for example, be interconnected using a system bus 650. The processor 610 can be capable of processing instructions for execution within the hardware configuration 600. In one implementation, the processor 610 can be a single-threaded processor. In another implementation, the processor 610 can be a multi-threaded processor. The processor 610 can be capable of processing instructions stored in the memory 620 or on the storage device 630.

The memory 620 can store information within the hardware configuration 600. In one implementation, the memory 620 can be a computer-readable medium. In one implementation, the memory 620 can be a volatile memory unit. In another implementation, the memory 620 can be a non-volatile memory unit.

In some implementations, the storage device 630 can be capable of providing mass storage for the hardware configuration 600. In one implementation, the storage device 630 can be a computer-readable medium. In various different implementations, the storage device 630 can, for example, include a hard disk device, an optical disk device, flash memory or some other large capacity storage device. In other implementations, the storage device 630 can be a device external to the hardware configuration 600.

The input/output device 640 provides input/output operations for the hardware configuration 600. In embodiments, the input/output device 640 can include one or more of a network interface device (e.g., an Ethernet card), a serial communication device (e.g., an RS-232 port), one or more universal serial bus (USB) interfaces (e.g., a USB 2.0 port), one or more wireless interface devices (e.g., an 802.11 card), and/or one or more interfaces for outputting video and/or data services to a multimedia device 105 of FIG. 1 and/or a client device 110 of FIG. 1 (e.g., television, mobile device, tablet, computer, STB, etc.). In embodiments, the input/output device can include driver devices configured to send communications to, and receive communications from one or more servers (e.g., intermediate server 135 of FIG. 1) and/or networks (e.g., subscriber network 120 of FIG. 1, WAN 115 of FIG. 1, local network 125 of FIG. 1, etc.).

Those skilled in the art will appreciate that the invention improves upon methods and systems for caching text-to-speech data. Methods, systems, and computer readable media can be operable to facilitate controlled caching of text-to-speech data. When text is identified for a text-to-speech conversion, a duration value to be associated with the text may be determined, and the identified text and duration value may be included within a request for a conversion of the text. An intermediate server may retrieve a speech file that is generated in response to the conversion request, and the intermediate server may cache the speech file for a certain period of time that is indicated by the duration value.

The subject matter of this disclosure, and components thereof, can be realized by instructions that upon execution cause one or more processing devices to carry out the processes and functions described above. Such instructions can, for example, comprise interpreted instructions, such as script instructions, e.g., JavaScript or ECMAScript instructions, or executable code, or other instructions stored in a computer readable medium.

Implementations of the subject matter and the functional operations described in this specification can be provided in digital electronic circuitry, or in computer software, firmware, or hardware, including the structures disclosed in this specification and their structural equivalents, or in combinations of one or more of them. Embodiments of the subject matter described in this specification can be implemented as one or more computer program products, i.e., one or more modules of computer program instructions encoded on a tangible program carrier for execution by, or to control the operation of, data processing apparatus.

A computer program (also known as a program, software, software application, script, or code) can be written in any form of programming language, including compiled or interpreted languages, or declarative or procedural languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification are performed by one or more programmable processors executing one or more computer programs to perform functions by operating on input data and generating output thereby tying the process to a particular machine (e.g., a machine programmed to perform the processes described herein). The processes and logic flows can also be performed by, and apparatus can also be implemented as, special purpose logic circuitry, e.g., an FPGA (field programmable gate array) or an ASIC (application specific integrated circuit).

Computer readable media suitable for storing computer program instructions and data include all forms of non-volatile memory, media and memory devices, including by way of example semiconductor memory devices (e.g., EPROM, EEPROM, and flash memory devices); magnetic disks (e.g., internal hard disks or removable disks); magneto optical disks; and CD ROM and DVD ROM disks. The processor and the memory can be supplemented by, or incorporated in, special purpose logic circuitry.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a sub combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Particular embodiments of the subject matter described in this specification have been described. Other embodiments are within the scope of the following claims. For example, the actions recited in the claims can be performed in a different order and still achieve desirable results, unless expressly noted otherwise. As one example, the processes depicted in the accompanying figures do not necessarily require the particular order shown, or sequential order, to achieve desirable results. In some implementations, multitasking and parallel processing may be advantageous.

We claim:

1. A method comprising:

receiving a request for a text-to-speech conversion, wherein the request is received by an intermediate server, and wherein the request is received from a media device;

identifying text to be converted, wherein the text is identified from the request;

identifying a duration value, wherein the duration value is identified from the request wherein the duration value is based upon one or more properties associated with the text, wherein the one or more properties associated with the text comprises at least an identification of a content type associated with the text;

retrieving a speech file associated with the identified text, wherein the speech file is produced from a text-to-speech conversion of the identified text; and caching the speech file at the intermediate server, wherein the speech file is cached at the intermediate server for a certain period of time that is indicated by the duration value.

2. The method of claim 1, wherein the one or more properties associated with the text comprises at least an identification of an application associated with the text.

3. The method of claim 1, further comprising:

outputting the speech file from the intermediate server to the media device; and outputting an instruction to the media device to cache the speech file for a certain period of time that is indicated by the duration value.

4. The method of claim 1, wherein the speech file is retrieved from a text-to-speech server.

5. An apparatus comprising one or more modules that:

receive a request for a text-to-speech conversion, wherein the request is received from a media device;

identify text to be converted, wherein the text is identified from the request;

identify a duration value, wherein the duration value is identified from the request;

retrieve a speech file associated with the identified text, wherein the speech file is produced from a text-to-speech conversion of the identified text; and cache the speech file for a certain period of time that is indicated by the duration value;

output the speech file to the media device; and output an instruction to the media device to cache the speech file for a certain period of time that is indicated by the duration value.

6. The apparatus of claim 5, wherein the duration value is based upon one or more properties associated with the text.

7. The apparatus of claim 6, wherein the one or more properties associated with the text comprises at least an identification of an application associated with the text.

8. The apparatus of claim 5, wherein the speech file is retrieved from a text-to-speech server.

9. One or more non-transitory computer readable media having instructions operable to cause one or more processors to perform the operations comprising:

receiving a request for a text-to-speech conversion, wherein the request is received by an intermediate server, wherein the request is received from a media device;

identifying text to be converted, wherein the text is identified from the request;

identifying a duration value, wherein the duration value is identified from the request, wherein the duration value is based upon one or more properties associated with the text, wherein the one or more properties associated with the text comprises at least an identification of a content type associated with the text;

retrieving a speech file associated with the identified text, wherein the speech file is produced from a text-to-speech conversion of the identified text; and caching the speech file at the intermediate server, wherein the speech file is cached at the intermediate server for a certain period of time that is indicated by the duration value.

10. The one or more non-transitory computer-readable media of claim 9, wherein the one or more properties associated with the text comprises at least an identification of an application associated with the text.

11. The one or more non-transitory computer-readable media of claim 9, wherein the instructions are further operable to cause one or more processors to perform the operations comprising:

outputting the speech file from the intermediate server to the media device; and outputting an instruction to the media device to cache the speech file for a certain period of time that is indicated by the duration value.

12. The one or more non-transitory computer-readable media of claim 9, wherein the speech file is retrieved from a text-to-speech server.

* * * * *